US005718647A

United States Patent [19]

Tiitola

[11] Patent Number: 5,718,647

[45] Date of Patent: Feb. 17, 1998

[54] REPLACEABLE HOCKEY STICK COMPONENTS

[75] Inventor: Antti-Jussi Tiitola, Kaivanto, Finland

[73] Assignee: KHF Sports Oy, Forssa, Finland

[21] Appl. No.: 621,515

[22] Filed: Mar. 25, 1996

Related U.S. Application Data

[63] Continuation of Ser. No. 242,102, May 13, 1994, abandoned.

[30] Foreign Application Priority Data

May 14, 1993 [CA] Canada ..... 2096304

[51] Int. Cl.[6] ..... A63B 59/14

[52] U.S. Cl. ..... 473/562

[58] Field of Search ..... 273/67 A; 473/562, 473/563, 560, 561

[56] References Cited

U.S. PATENT DOCUMENTS

| | | | |
|---|---|---|---|
| 1,601,116 | 9/1926 | Hall . | |
| 2,569,395 | 9/1951 | Zupanick . | |
| 3,638,942 | 2/1972 | Bassett . | |
| 3,720,410 | 3/1973 | Saytar . | |
| 3,934,875 | 1/1976 | Easton et al. . | |
| 3,961,790 | 6/1976 | Milligan . | |
| 4,358,113 | 11/1982 | McKinnon et al. | 273/67 A |
| 4,361,325 | 11/1982 | Jansen . | |
| 4,600,192 | 7/1986 | Adachi | 273/67 A |
| 4,684,130 | 8/1987 | Drolet et al. . | |
| 5,312,100 | 5/1994 | Ilacqua | 273/67 A |

FOREIGN PATENT DOCUMENTS

| | | | |
|---|---|---|---|
| 705274 | 3/1965 | Canada | 273/67 A |
| 272851 | 3/1971 | U.S.S.R. | 273/67 A |

*Primary Examiner*—Mark S. Graham

*Attorney, Agent, or Firm*—Armstrong, Westerman, Hattori, McLeland & Naughton

[57] ABSTRACT

Replaceable blade and handle components are provided for a game stick. One of the components comprises a male element and the other comprises a socket element. The socket element has a cavity the surfaces of which can frictionally and releasably engage corresponding surfaces of the male element while leaving corner pocket(s) wherein facing surfaces are not in frictional contact. The present invention relates to game sticks, in particular to hockey sticks or the like, which comprise replaceable blade and handle components; such sticks include, for example, ice hockey sticks (including goalie sticks), street hockey sticks and the like. The present invention, by way of example only, will be described hereinafter in relation to an ice hockey stick.

44 Claims, 10 Drawing Sheets

Fig.1
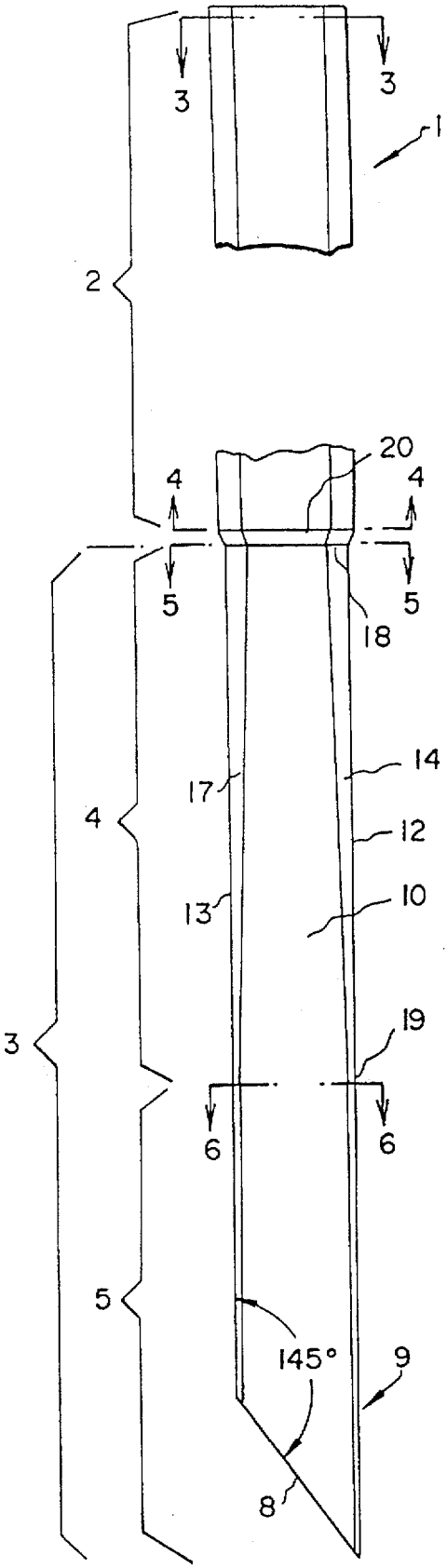
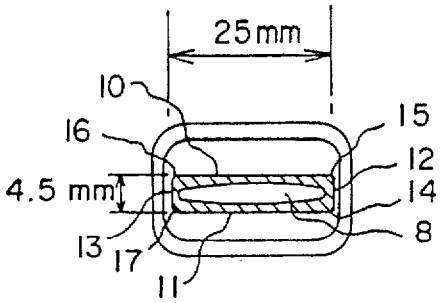
Fig. 7
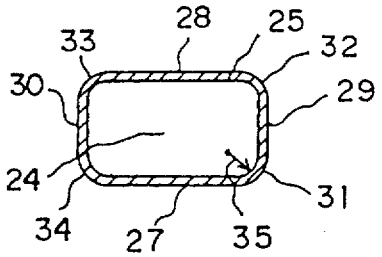
Fig. 10
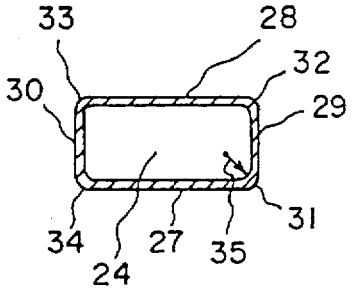
Fig.11

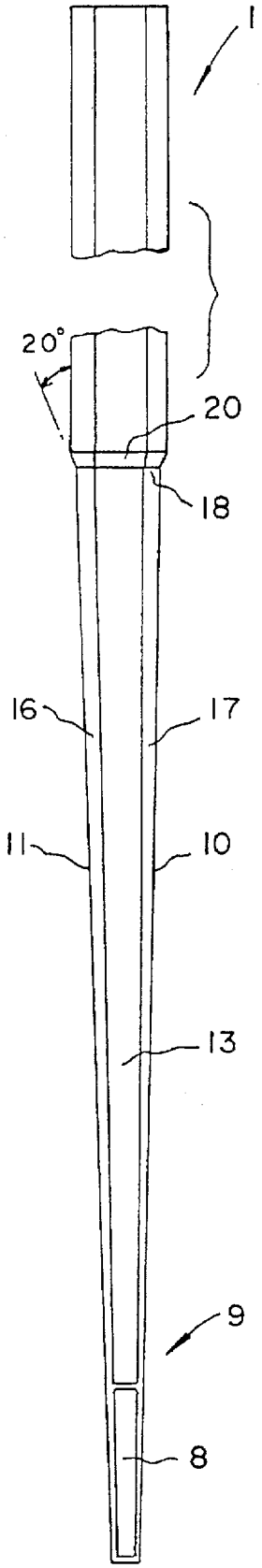
Fig. 2
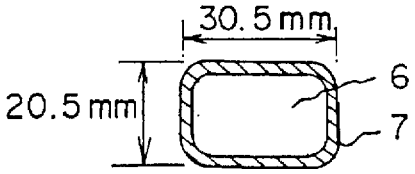
Fig. 3
Fig. 4
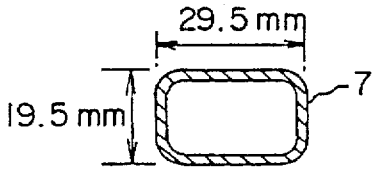
Fig. 5
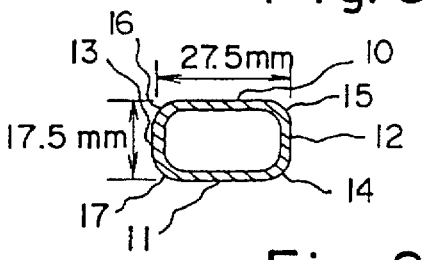
Fig. 6
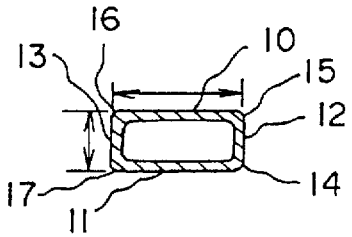

REPLACEABLE HOCKEY STICK COMPONENTS

This application is a continuation of application Ser. No. 08/242,102 filed May 13, 1994, now abandoned.

DESCRIPTION OF PRIOR ART

Ice hockey sticks generally consist of two basic elements, namely an elongated handle component and a blade secured to the lower end of the handle.

A hockey stick must be extremely strong in order for it to indure (for an acceptable period of time) the tremendous forces developed between it and a puck.

Traditional (ice) hockey sticks are made of one or more pieces (e.g. layers) of wood. A shortcoming of wooden blades is that they are generally not strong enough and thus do not hold up well under the usually conditions encountered when playing hockey. Moreover, labour and material costs for the manufacture of wooden blades are relatively high.

A wooden hockey stick may also be reinforced with fiber (e.g. glass) fabric which is impregnated and bonded to the wooden surface with a synthetic resin. These types of reinforced wooden blades have given good results including good playing performance; this performance is mainly the result of the combination of low weight and high stiffness.

Hockey sticks made entirely out of strong lightweight metal (e.g. aluminum) or of strong synthetic materials are also known; these include composite blades comprising a fiber (e.g. glass) laminated core (see for example U.S. Pat. Nos. 4,059,269, 4,488,721, 4,591,155, 4600192, Finnish patent no. 65018, etc.).

Notwithstanding the materials of their construction, however, hockey sticks receive such rough treatment during use, that they are still commonly subject to a high rate of wear and breakage.

Additionally, it is common for individual players to prefer hockey sticks having a particular set of characteristics relating to size, weight, etc. The particular preferences of an individual player with respect to a stick may apply both to the handle and to the blade. During play either the blade or the handle portion may break. A common hockey stick design preference includes the curvature of the blade; for example, a blade may include a primary concave contact face.

Accordingly, since any hockey stick has a limited useful lifetime, a large number of such preferred sticks must be maintained, especially for professional players.

A number of solutions have been proposed whereby provision is made for a replaceable blade component and/or replaceable handle component; please see for example U.S. Pat. Nos. 3,961,790, 3,934,875 and 3,638,942, the entire contents of which are herein incorporated by reference. These known attempts to provide hockey stick components have generally not been able to provide a mechanism whereby the handle may be secured to the blade component in a sufficiently, rigidly, yet easily detachable full stress transfer relation.

It would be advantageous to have separate blade and handle components which can be engaged in a tight, rigidly detachable fashion without the use of additional mechanical attachment means such as screws, bolts, etc. It would thus be advantageous if the joint between separate blade and handle components could be a releasable self-holding joint in the absence of such mechanical attachments.

SUMMARY OF THE INVENTION

In accordance with an aspect, the present invention provides a kit for making a game (e.g. hockey) stick comprising an elongated handle and a blade. The kit comprises a blade component having a shank member and an elongated handle component having an end member.

The blade component comprises a blade having a toe portion and a heel portion. The shank member of the blade component extends away from the heel portion and has an end remote from the heel portion.

The kit is characterized in that one of the shank and the end members comprises a socket element and the other of the shank and the end members comprises a male element, in that the male element has a tapered shape, the male element tapering to a terminal portion, in that the male element comprises a plurality of first side members and a plurality of first corner members, each first side member defining an engagement surface spacing apart two first corner members, in that the socket element comprises an opening, a plurality of cavity side members and a plurality of cavity corner members, each cavity side member defining an engagement surface spacing apart two cavity corner members, the cavity side members and the cavity corner members defining a cavity extending from the opening, the cavity having a bottom portion remote from the opening, in that the male element and the cavity are configured so that the male element is telescopically engageable within the cavity of the socket element in tight frictional gripping relation such that the elongated handle component and the blade component are thereby rigidly and detachably secured together, the first side members and respective cavity side members define a plurality of pairs of facing side members, each pair of facing side members comprising a first side member disposed opposite a respective cavity side member, and the first corner members and respective cavity corner members define a plurality of pairs of facing corner members, each pair of facing corner members comprising a first corner member disposed opposite a respective cavity corner member, and in that the first corner members and the cavity corner members are configured such that, when the male element is telescopically engaged within the cavity of the socket element, for each pair of facing side members, the engagement surfaces thereof, are in said frictional gripping relation, and for at least one pair of facing corner members, the first corner member and the cavity corner member thereof, are in a spaced apart relation, said spaced apart relation extending over at least a portion of the cavity corner member thereof.

In accordance with an additional aspect the present invention provides a game (e.g. hockey) stick comprising a blade component having a shank member and an elongated handle component having an end member the blade component comprising a blade having a toe portion and a heel portion, the shank member extending away from the heel portion and having an end remote from the heel portion, characterized in that one of the shank and the end members comprises a socket element and the other of the shank and the end members comprises a male element in that the male element has a tapered shape, the male element tapering to a terminal portion, in that the male element comprises a plurality of first side members and a plurality of first corner members, each first side member defining an engagement surface spacing apart two first corner members, in that the socket element comprises an opening, a plurality of cavity side members and a plurality of cavity corner members, each cavity side member defining an engagement surface spacing apart two cavity corner members, the cavity side members and the cavity corner members defining a cavity extending from the opening, the cavity having a bottom portion, in that the male element and the cavity are configured so that the male element is telescopically engaged within the cavity of the socket element in tight frictional gripping relation such that the elongated handle component and the blade component are thereby rigidly and detachably secured together, the first side members and respective cavity side members define a plurality of pairs of facing side members, each pair of facing side members comprising a first side member disposed opposite a respective cavity side member, and the first corner members and respective cavity corner members define a plurality of pairs of facing corner members, each pair of facing corner members comprising a first corner member disposed opposite a respective cavity corner member, in that, for each pair of facing side members, the engagement surfaces thereof, are in said frictional gripping relation, and in that, for at least one pair of facing corner members, the first corner member and the cavity corner member thereof, are in a spaced apart relation, the spaced apart relation extending over at least a portion of the cavity corner member thereof.

In accordance with a further particular aspect, the present invention provides a blade component for a game (e.g. hockey) stick comprising a socket element for tight frictional detachable engagement with a tapered male end element of an elongated handle component for forming a game (e.g. hockey) stick, characterized in that the blade component comprises a shank member and a blade, in that the blade has a toe portion and a heel portion, in that the shank member extends away from the heel portion and has an end remote from the heel portion, in that the shank member comprises a socket element, the socket element comprising an opening, a plurality of cavity side members and a plurality of cavity corner members, each cavity side member defining an engagement surface spacing apart two cavity corner members, the cavity side members and the cavity corner members defining a cavity extending from the opening, the cavity having a bottom portion remote from the opening, the opening being disposed at the end of the shank member remote from the heel portion the cavity being disposed within the shank member the cavity tapering from the opening to the bottom portion, and in that the cavity corner members each comprise a concavely curved corner surface within the cavity extending from the opening.

In accordance with another particular aspect, the present invention provides an elongated handle component for a game (e.g. hockey) stick comprising a male end element for tight frictional detachable engagement with a socket element of a blade component for forming a game (e.g. hockey) stick, characterized in that the male element has a tapered shape, the male element tapering to a terminal portion, in that the male end element comprises a plurality of side members and a plurality of corner members, each side member defining an engagement surface spacing apart two corner members, and in that the side corner members each comprise a convexly curved outer surface.

If the game stick is a hockey stick, the shank member usually extends away from the heel portion of the blade at some desired obtuse angle to the blade, i.e. the blade and shank define such an obtuse angle.

A game stick, in accordance with the present invention, is assembled by inserting the male element through the opening into the cavity and forcing it into the cavity a predetermined distance whereby a tight frictional detachable engagement is achieved between the stick components, i.e. until a desired (friction) wedge fit is achieved. In order to provide (the desired) frictional engagement therebetween, the male element will of course be sized such that when in the active wedge engaging position, it's engagement surfaces are able to frictionally engage the corresponding engagement surfaces of the female cavity.

The (cross sectional) shape of the cavity may take on any desired aspect, whatsoever, provided that the engagement surfaces of the tapered male element may snugly and releasably engage the corresponding engagement surfaces of the cavity as herein described. Similarly, the (cross sectional) shape of the male element may take on any desired aspect, whatsoever, but likewise provided that the engagement surfaces of the tapered male element may snugly and releasably engage the corresponding engagement surfaces of the cavity. The male and female elements may, for example, have a constant or uniform cross-section over their entire length. The cross-section(s) may be polygonal (e.g. triangular, rectangular and the like), lens like (e.g. biconvex) etc. i.e. any shape which can provide for corner pockets as described herein.

The male element may, in particular, have a wedge-like shape for wedge type engagement in a similarly shaped cavity in the socket element. Thus, the male element may, for example, have a rectangular cross sectional shape and may comprise a pair of opposed broad first side members and a pair of opposed narrow first side members. The cavity may similarly have a pair of corresponding opposed broad cavity side members and a pair of opposed narrow cavity side members. The male element may have a taper(ed) configuration or shape generally obtained by having the engagement surfaces of the broad first side members converge towards each other to the terminal portion of the male element; similarly, the corresponding engagement surfaces of the broad cavity side members may be shaped to converge inwardly towards each other from the opening of the socket element to the bottom part thereof.

For a wedging type engagement, the opposed engagement surfaces of the narrow side members of the male element and the cavity element may similarly converge or they be (substantially) parallel (i.e. they may be parallel or may converge at such a small angle of convergence that over the length of the male element, the surfaces deviate from the parallel relation only to a minor degree).

However, in the case where the opposed narrow side members of the male element and the cavity are more or less parallel, a relatively high degree of force will be required (e.g. on the part of the user) in order for the male element to be to inserted in and removed from the female element; i.e. frictional forces acting over the entire length of the male element will have to be overcome during the entire time that the male element is within the female element.

On the other hand, a wedge shape for the male element and the cavity wherein the opposed narrow side members converge towards each other is advantageous from the point of view of facilitating the engagement and disengagement of the male element relative to the female element. Such a wedge shape may allow a relatively large portion of the length of the male element to be inserted in the female element before actual frictional engagement occurs such that the distance that the male element must be moved in order to break the frictional engagement may be substantially reduced.

Thus, preferably, the engagement surfaces of the narrow first side members may similarly converge towards each other, the engagement surfaces of the narrow cavity side members converging in corresponding fashion.

As mentioned above, the first corner members and corresponding cavity corner members define a plurality of facing corner members. The male element and the cavity are configured such that, when the male element is telescopically engaged within the cavity of the socket element, the first corner member and the cavity corner member, of at least one such pair of corner members, are in a spaced apart relation. In effect, any spaced apart corner members define a corner pocket where the male element does not (frictionally) engage the walls of the cavity. The provision of such corner pocket(s) give the cavity and the male element a relatively weaker (frictional) hold on each other than if they were to (frictionally) engage in all of the corner areas; this facilitates the insertion in and withdrawal of the male element with respect to the cavity. The degree of weakening will depend on the number of such pockets, the maximum number corresponding to the number of pairs of facing corner members. The degree of weaking will also depend on other factors such as, for example, the overall surface area of the first corner member(s) not in contact with the corresponding facing corner member(s). Additionally, the pockets may act to provide a springy quality to the combination (especially if the elements are thin walled). This springy quality may allow for (slight) deformation in the socket when the male element is disposed into the female element. Due to such deformation the frictional contact may be reached more or less simultaneously for the narrow and broad side members even if the manufacturing precision of these elements is not exact. Thus, this deformation ability (of the socket) allows for larger tolerances of manufacture without sacrificing the function of the frictional contact.

The spaced apart relation may, for example, extend, from the opening of the socket element, over at least a portion of a cavity corner member. The spaced apart relation may thus extend over at least a major (e.g. at least a substantial) portion of the cavity corner member extending from the opening. If, for example, as preferred, the cavity is defined by relatively thin walls the provision of the corner pocket(s) will (as discussed above) give the cavity walls a springy quality allowing for deformation of the walls when the male element is disposed therein (also facilitating the insertion and removal of the male element).

In accordance with another particular aspect of the invention the first corner member of each pair of facing corner members may, for example, comprise a convexly curved corner surface and the respective cavity corner member may comprise a concavely curved corner surface, and (in order to define the corner pocket(s)) the convexly curved surface of the first corner member of each pair of corner members may have a radius of curvature greater than the radius of curvature of the concavely curved surface of the respective facing cavity corner member.

The difference in radius of curvature of the convexly curved surface with respect to the concavely curved surface may extend over at least a portion of the respective cavity corner member extending from the opening of the socket element towards the bottom portion of the cavity; the difference in radius may for example extend over at least a substantial portion of the respective cavity corner member extending from the opening.

The corner pocket(s) may also be used to provide a path for air in the cavity to escape rather than being compressed between the cavity walls and the male element once they are in contact but not in their final positions relative to each other. Conversely when the male element is to be removed, the corner pockets may allow a path for air to enter into the cavity below the terminal portion of the male member so as to avoid having to overcome (i.e. so as to inhibit the formation of) a potential vacuum between the male element and the cavity walls. The corner pocket(s) may, for example, extend from the opening to the bottom portion of the cavity.

Depending on the frictional forces (desired) between the male element and the walls of the cavity, a plurality of such corner pockets will usually be present. Preferably, however, in accordance with an aspect of the present invention, the corner members of each (i.e. all) of the pairs of facing corner members are in the spaced apart relation.

The male element and the cavity are of course configured such that the degree of frictional engagement therebetween (for insertion or removal) may be relatively easily overcome either manually or by a suitable puller mechanism. The two components may, for example, be separated by using a vice grip for gripping one component and pulling manually on the other element. Alternatively, the two components may be manipulated by using one vise grip to grip one component and a second vise grip to grip the other, the two vice grips being suitably interconnected by a(n screw type) mechanism which can force the male element into the cavity or pull it out by advancing the vice grips towards or away from each other as the case may be.

In accordance with another particular aspect of the present invention the end member of the elongated handle component may comprise the male element and the shank member of the blade component may comprise the socket element. In this case the opening of the socket element is disposed at the end of the shank member remote from the heel portion, i.e. the cavity is disposed within the shank member. The bottom portion of the cavity may also extend right into the heel portion of the blade.

With the socket element in the shank member of the blade, the terminal portion of the male element may be (able to be) disposed at any point in the shank cavity. However, if the terminal portion is disposed so as to be within the shank but above the heel portion, the interface between the male element and the remaining portion of the shank below the terminal portion, may serve as a potential fulcrum (lever) point area at which stress may be accentuated. The application of stress at such a lever point area may act to reduce the overall life of the blade component, i.e. the blade component may snap or break prematurely in this area.

Preferably, therefore, a bottom portion of the cavity extends into the heel portion of the blade and the male element is configured such that the terminal or foot portion of the male element is (able to be) disposed in the bottom portion of the cavity extending into the heel portion i.e. so as to inhibit or minimize such lever action. In this case, the spaced apart relation referred to above with respect to facing corner members, may in particular extend from the opening of the socket element to the bottom part of the cavity.

The opposed engagement surfaces may have a corresponding curved (i.e. arced) or flat (i.e. planar) aspect. However, in accordance with a further particular aspect of the invention, the engagement surface of each first side member may be a planar surface; likewise the engagement surface of each cavity side member may also be a planar surface.

In accordance with an additional particular aspect of the present invention,

- the cavity may have a rectangular cross-sectional shape,
- the cavity side members may consist of a pair of opposed broad cavity side members and a pair of opposed narrow cavity side members,
- each cavity corner member may connect together a broad cavity side member and a narrow cavity side member,
- the male element may have a rectangular cross-sectional shape,
- the first side members may consist of a pair of opposed broad first side members and a pair of opposed narrow first side members,
- each first corner member may connect together a broad first side member and a narrow first side member,
- the broad and narrow first side members may each define a planar engagement surface,
- the broad and narrow cavity side members may each define a planar engagement surface,
- the planar engagement surfaces of the broad first side members may converge towards each other to the terminal portion,
- the planar engagement surfaces of the narrow first side members may converge towards each other to the terminal portion,
- the planar engagement surfaces of the broad cavity side members may converge inwardly towards each other from the opening of the socket element to the bottom portion,
- the planar engagement surfaces of the narrow cavity side members may converge inwardly towards each other from the opening of the socket element to the bottom portion,
- the male element and the cavity may be configured so that the male element is telescopically engageable within the cavity of the socket element such that each broad first side member faces a respective broad cavity side member and each narrow first side member faces a respective narrow cavity side member,
- the planar surface of each broad first side member is able to frictionally engage the planar surface of a respective broad cavity side member in the above mentioned frictional gripping relation, and
- the planar surface of each narrow first side member is able to frictionally engage the planar surface of a respective narrow cavity side member in the above mentioned frictional gripping relation.

In accordance with the present invention the male element may be hollow. The shank member and the male member may be of fiber reinforced plastic material. The shank member may comprise relatively thin walls (defining the cavity); a hollow male element may also comprise relatively thin walls.

In accordance with the attachment mechanism of the present invention a precise registration between the blade and handle components may be achieved such that loads acting on the blade are effectively transmitted to the handle and vice versa.

The present invention also provides for a game (hockey) stick which may be readily disassembled and assembled for the purpose of replacing the handle and/or blade.

In the drawings which illustrate example embodiments of the present invention,

FIG. 1 is a partially cutaway side view of an elongated handle component comprising an embodiment of a male element, the figure showing one of the two opposed broad first side members thereof;

FIG. 2 is a partially cutaway side view of the elongated handle component shown in FIG. 1, the figure showing one of the two opposed narrow first side members thereof;

FIG. 3 is a cross sectional view along 3—3 of FIG. 1;

FIG. 4 is a cross sectional view along 4—4 of FIG. 1;

FIG. 5 is a cross sectional view along 5—5 of FIG. 1;

FIG. 6 is a cross sectional view along 6—6 of FIG. 1;

FIG. 7 is a bottom view of the handle component of FIG. 1;

FIG. 10 is a cross sectional view along 10—10 of FIG. 9;

FIG. 11 is a cross sectional view along 11—11 of FIG. 9;

Figure 12A:
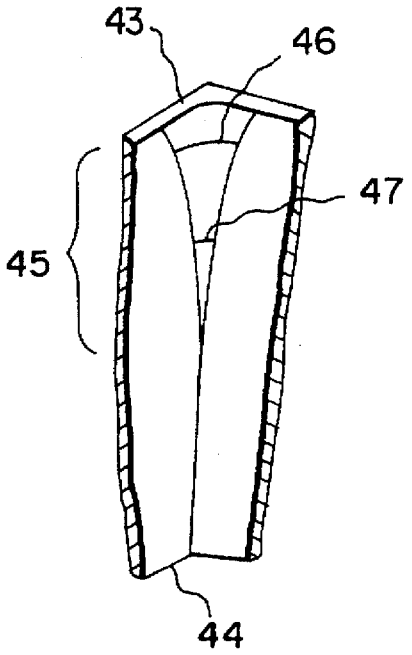
Figure 12B:
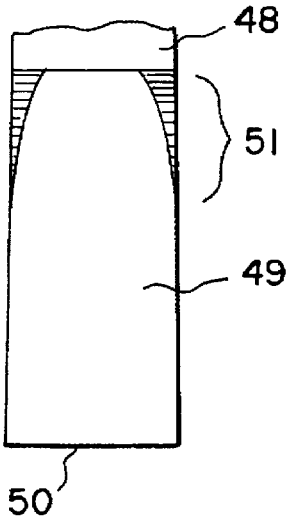

FIG. 12*a* is a cutaway schematic view of a cavity showing an example corner member thereof;

FIG. 12*b* is a schematic side view of a male element showing example corner members thereof for facing cavity corner members as shown in FIG. 12*a;*

Figure 13A:
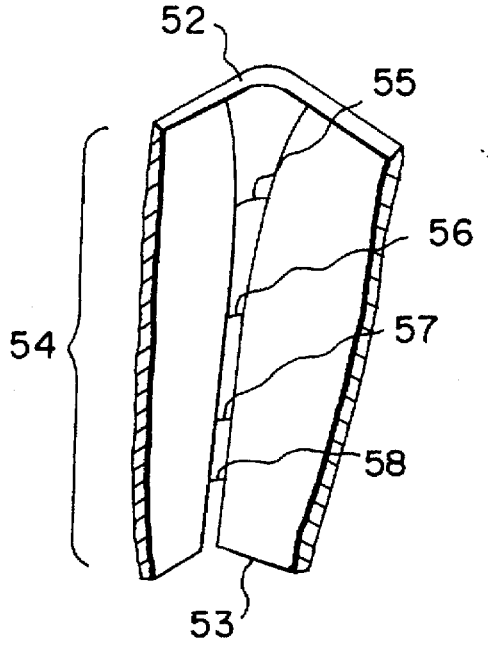
Figure 13B:
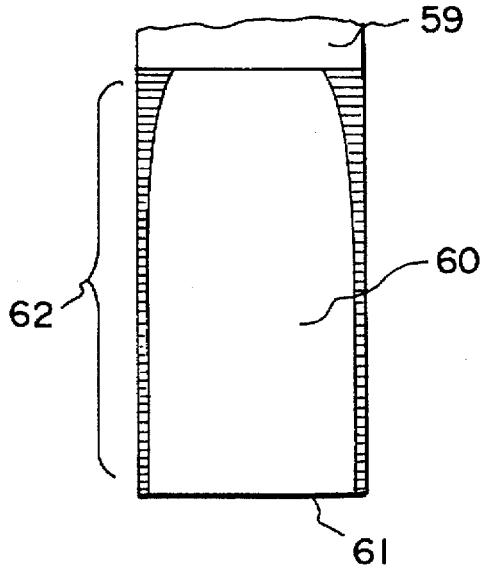

FIG. 13*a* is a cutaway schematic view a cavity showing another example corner member thereof;

FIG. 13*b* is a schematic side view of a male element showing other example corner members thereof for facing cavity corner members as shown in FIG. 13*a;*

Figure 14:
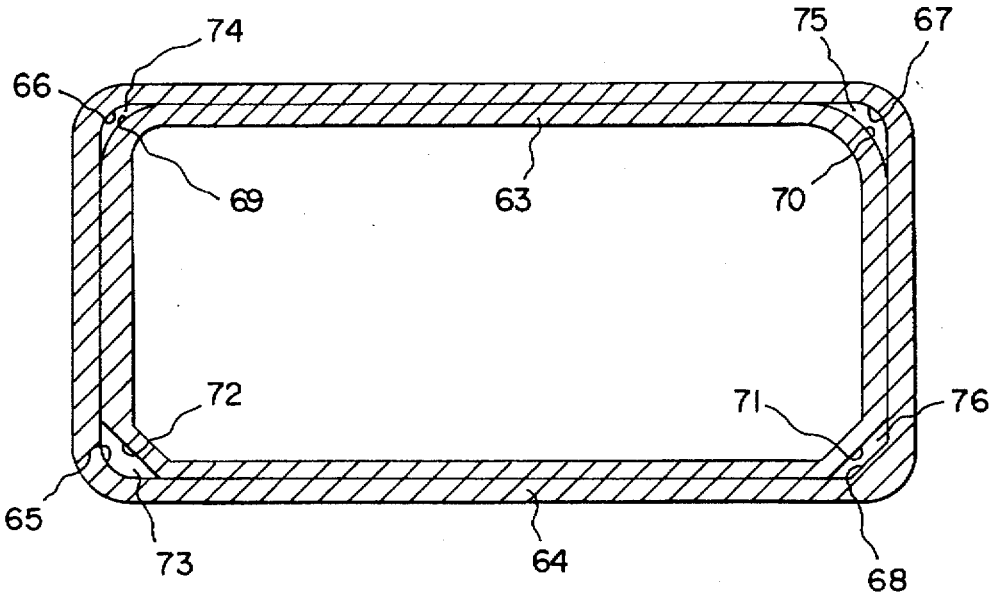
Figure 15:
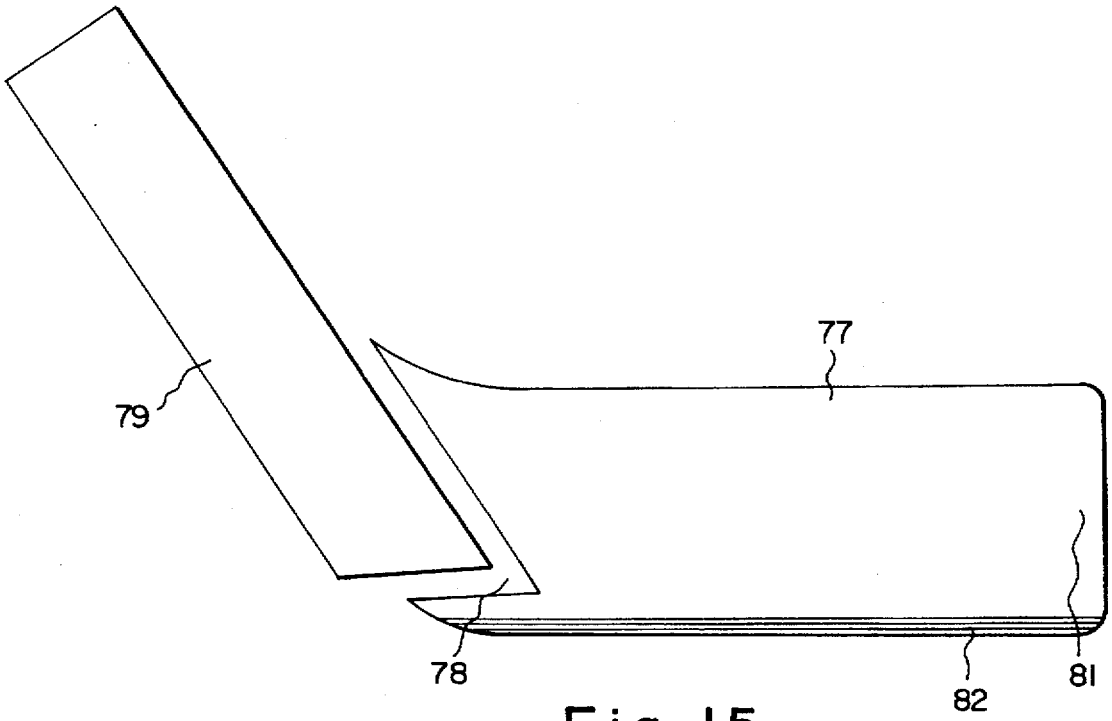
Figure 16:
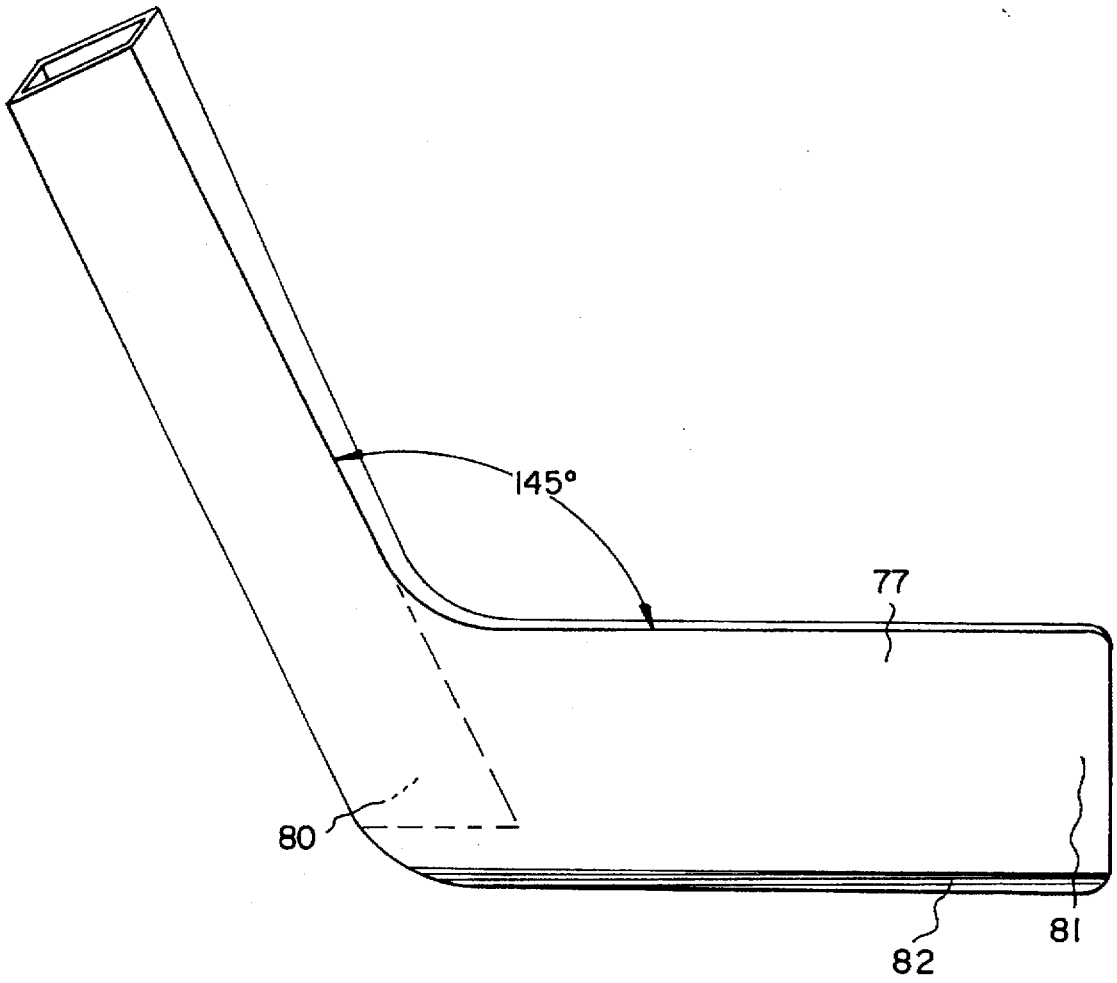
Figure 17:
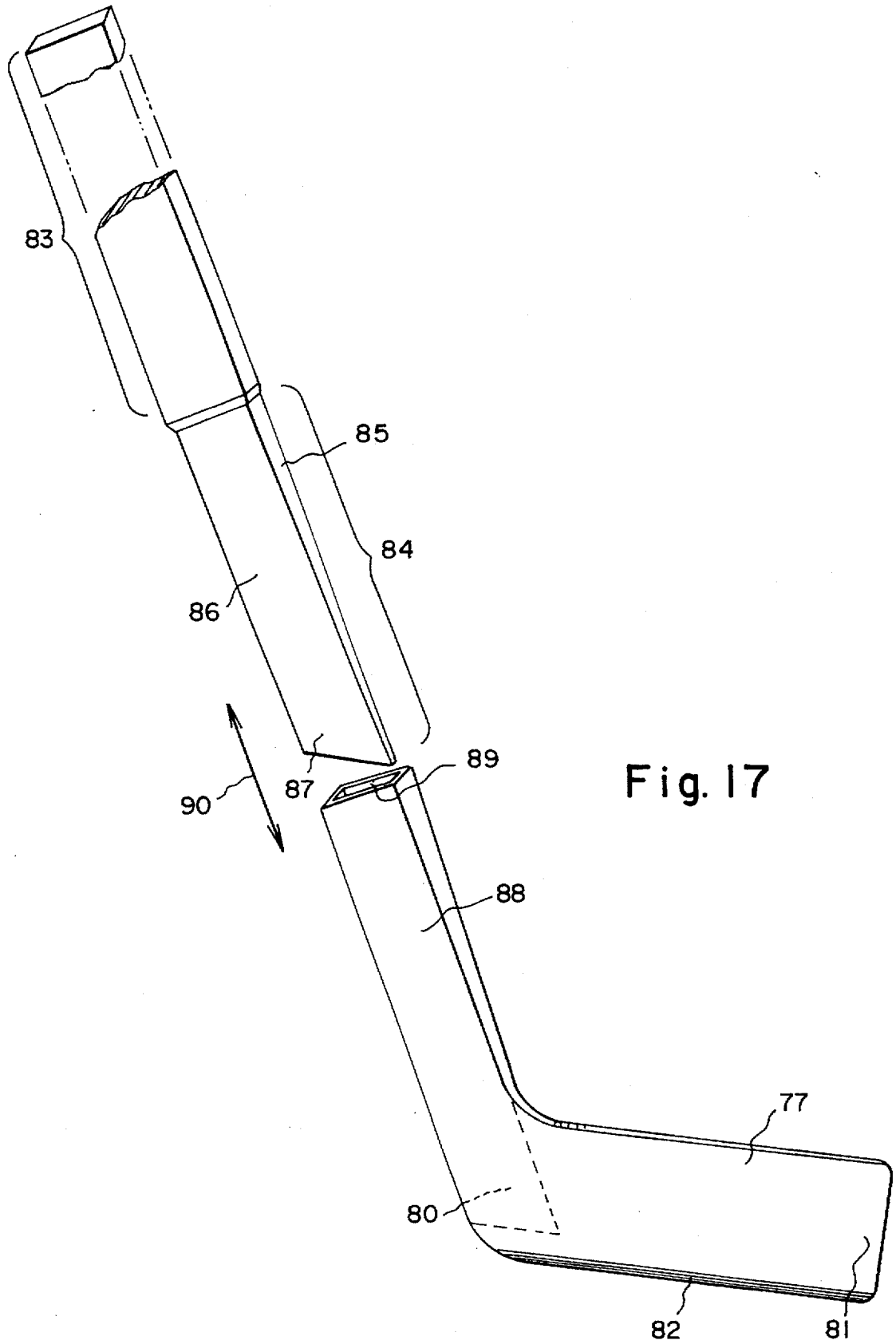
Figure 19:
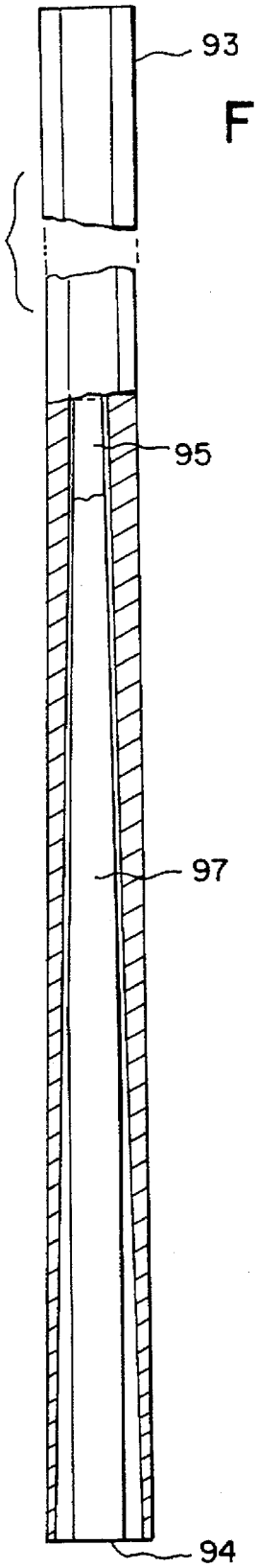
Figure 21:
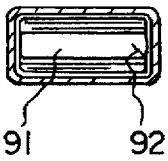
Figure 20:
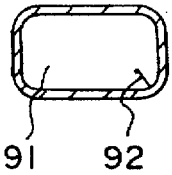
Figure 18:
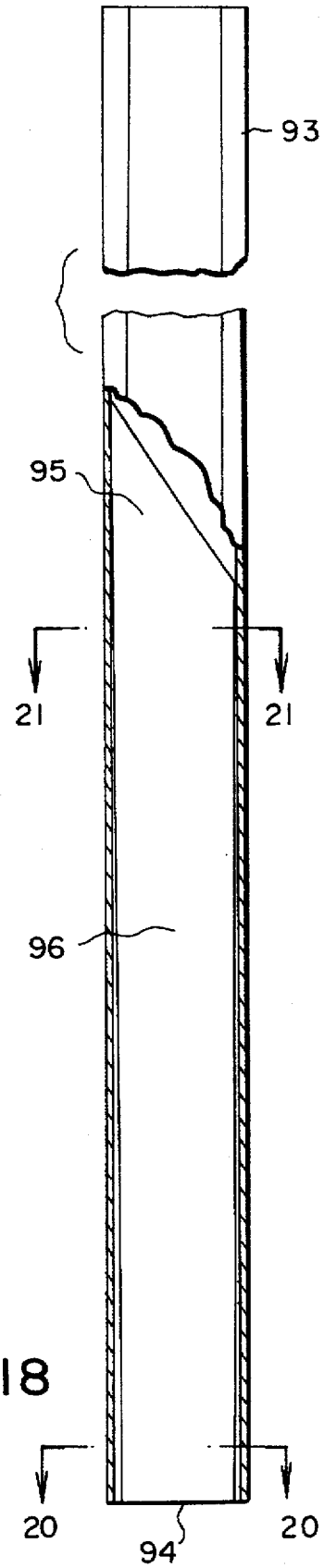
Figure 23:
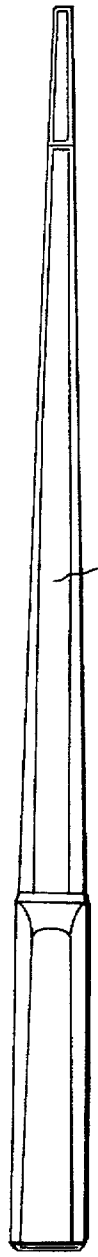
Figure 22:
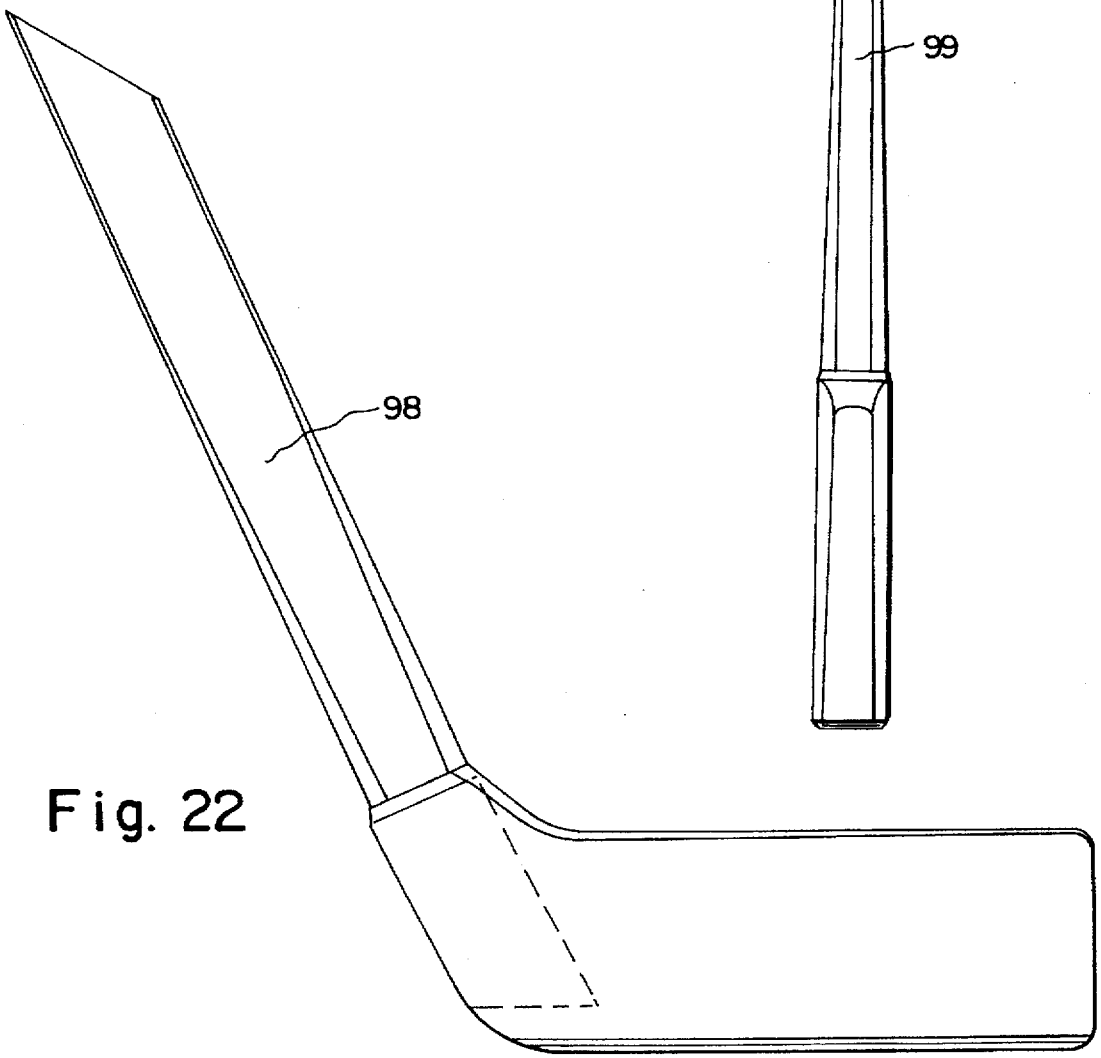
Figure 25:
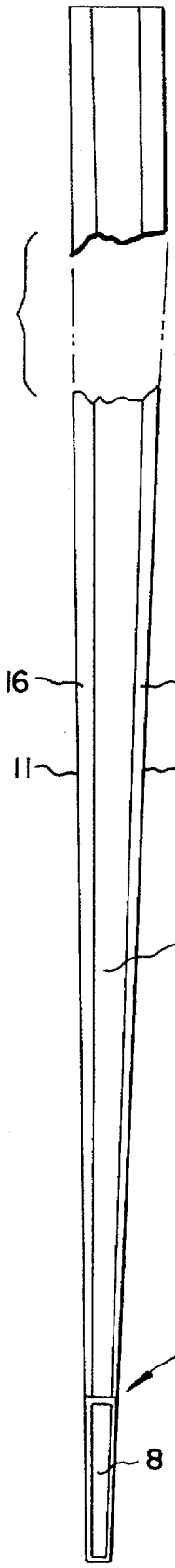
Figure 24:
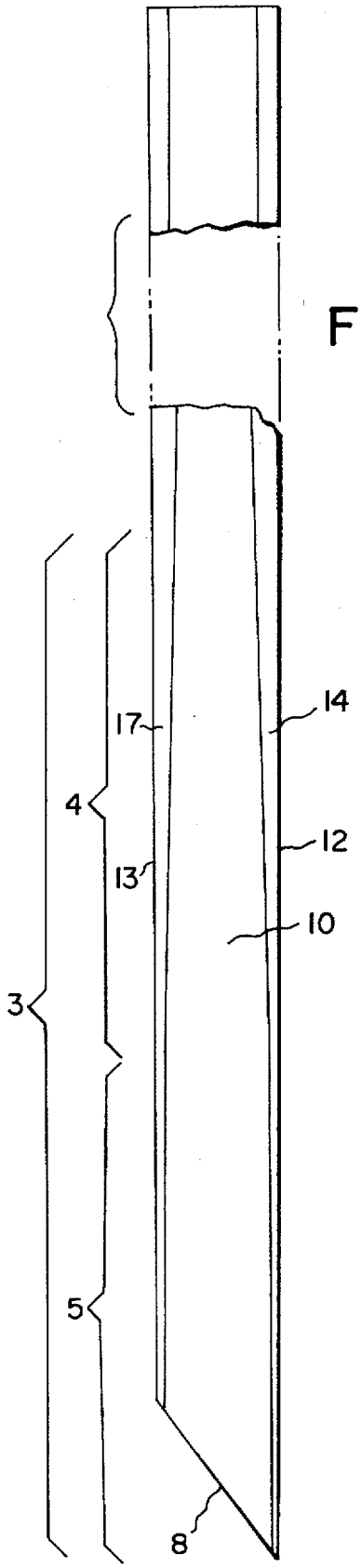

FIG. 14 is a cross sectional view of a male element in frictional contact with the walls defining the cavity with example types of corner pocket configurations being shown;

FIG. 15 is a schematic view of a casing as shown in FIGS. 8 to 11 and a blade prior to their being fixed together to form an integral blade component;

FIG. 16 is a side view of a blade component with the joint casing of FIGS. 8 to 11 incorporated therein;

FIG. 17 illustrates the positioning of a handle component and a blade component for joining and separation therefrom;

FIG. 18 is a partially cutaway side view of an elongated handle component comprising an embodiment of a socket or female element, the figure showing one of the two opposed broad cavity side members thereof;

FIG. 19 is a partially cutaway side view of the elongated handle component shown in FIG. 18, the figure showing one of the two opposed narrow cavity side members thereof;

FIG. 20 is a cross sectional view along 20—20 of FIG. 18 with all of the wall members being shown;

FIG. 21 is a cross sectional view along 21—21 of FIG. 18 with all of the wall members being shown;

FIG. 22 is a side view of another embodiment of a blade component comprising an embodiment of a male element, the figure showing one of the two opposed broad first side members thereof;

FIG. 23 is a side view of the blade component shown in FIG. 22, the figure showing one of the two opposed narrow first side members of the male element;

FIG. 24 is a partially cutaway side view of another example elongated handle component comprising an embodiment of a male element having no (distinct) shoulder between the male element and the main shaft part of the handle, the figure showing one of the two opposed broad first side members thereof; and FIG. 25 is a partially cutaway side view of the elongated handle component shown in FIG. 24, the figure showing one of the two opposed narrow first side members thereof.

FIGS. 1 to 7 illustrate an embodiment of an elongated, hollow, thin walled handle component which comprises an example male end element of the present invention. The handle component 1 comprises a hollow main body portion 2 and a hollow end portion 3. The lower end portion 3 defines the male element and is itself comprised of two portions 4 and 5. The overall length of the handle may be 1540 mm, portion 5 being 100 mm long while portion 4 and the part between cross sectional lines 4—4 and 5—5 being 140 mm long.

The handle component 1 has a central longitudinally extending cavity 6 surrounded and defined by a thin peripheral wall 7 (see FIG. 3). As may be seen from FIGS. 3 to 7, the cavity 6 and the thin peripheral wall 7 extend the full length of the handle component 1, the cavity 6 terminating with an opening 8 in the terminal portion 9 of the male element. The handle component may, for example, be made of a fiber reinforced plastics material comprising a suitable (known) resin and a suitable (known) fiber reinforcement element; the resin may, for example, be a polyester or epoxy resin while the fiber reinforcement element may, for example, be of glass fibers, carbon fibers, organic (polyamide) fibers, etc. A fiber reinforcement element which may be used in the context of the present invention may take any suitable (known) form, such as, for example, fiber strands, a fabric (e.g. a woven or non-woven fabric), etc. The thin peripheral wall of the handle component may, for example, be built up in any (known) manner on a mandrel of appropriate shape and construction, from suitable (known) resin impregnated fiber materials. The wall may have any desired thickness (e.g. 3 mm to 6 mm or more); the wall for the embodiment shown has a thickness of about 3 mm.

The male end portion 3 has a rectangular cross sectional configuration and thus has two opposed broad side walls 10 and 11 and two opposed narrow side walls 12 and 13. The male end portion is tapered, tapering inwardly to the terminal portion 9. As may be seen from FIGS. 5, 6 and 7, the opposed broad side walls 10 and 11 converge towards each other to the terminal portion 9; similarly, the opposed narrow side walls 12 and 13 converge towards each other to the terminal portion 9 but to a lesser degree than the broad side walls. The converging walls provide the male element with a wedge-like aspect. The opposed broad and narrow side walls define planar engagement surfaces.

The walls 10, 11, 12 and 13 are linked together by four corners 14, 15, 16 and 17. These corners have a rounded aspect such that they each present a convex outer surface over the entire length of the male end portion 3. For any given cross-section of the male element 3, the corners of the cross-section each have the same radius of curvature for the outer surface. However, the outer radius of curvature of each these corners diminishes going from the top part 18 of portion 4 to the top part 19 of the lower portion 5 of the male element 3. Thus, over the length of the portion 4 of the male end 3, the radius of curvature changes i.e. gets smaller. The radius of curvature for the portion 4 may take on any desired values, keeping in mind that the surfaces of these corners are to be spaced apart from corresponding surfaces of the cavity for the purpose of defining the above mentioned corner pockets; the radius of curvature for each of the corners may, for example, vary from 6 mm at top part 18 to 1.5 mm at top part 19.

The radius of curvature of the outer surfaces of the corners 14 to 17 in the portion 5 of the male element, is substantially constant over the entire length of this portion e.g. at 1.5 mm.

As may be seen the terminal portion 19 is cut at an obtuse angle so as to present an angled end edge which defines the opening 18; the obtuse angle may take any desired value (e.g. from above 90 to below 180 degrees). In the embodiment shown the obtuse angle is 145 degrees. This obtuse angle may, for example, if desired, correspond to the obtuse angle between the shank and the blade of a blade component (see FIG. 15).

The upper portion 2 of the handle component is linked to the lower portion 3 by an inwardly angled transition shoulder 20; the angle of the shoulder may take any desired value (e.g. from 0 to 90 degrees). In the embodiment shown the angle is 20 degrees.

Referring to FIGS. 8 to 11, these figures illustrate a hollow thin walled female joint case 21 which can be fixed to a blade to make a blade component. The joint case shown, when fixed to a blade, defines the shank member of the blade component, the shank thus having a socket or female element.

The female joint case 21 comprises two portions 22 and 23. The length of the case 21 shown is 250 mm, the portion 23 being 110 mm long.

The female joint case 21 has a central longitudinally extending cavity 24 surrounded and defined by a thin peripheral wall 25 (see FIG. 10). As may be seen from FIGS. 10 and 11, the cavity 24 and the thin peripheral wall 25 extend the full length of the joint case 21, the cavity 24 terminating at a bottom portion 26 which may or may not be open ended as desired. The female joint case 21, as in the case of the handle component shown in FIGS. 1 to 7, may also be made of a fiber reinforced plastics material comprising a suitable (known) resin and a suitable (known) fiber reinforcement element as discussed above. The thin peripheral wall of the female joint case 21 may, for example, be built up in any (known) manner on a mandrel of appropriate shape and construction, from suitable (known) resin impregnated fiber materials. The wall may have any desired thickness (e.g. 1 mm to 3 mm or more); the wall for the embodiment shown has a thickness of about 1 mm.

The female joint case 21 has a rectangular cross sectional configuration and thus has two opposed broad cavity side walls 27 and 28 and two opposed narrow cavity side walls 29 and 30. The cavity 24 is tapered, tapering inwardly to the bottom portion 26. As may be seen from FIGS. 10 and 11, the opposed broad side walls 27 and 28 converge towards each other to the bottom portion 26; similarly, the opposed narrow side walls 29 and 30 converge towards each other to the bottom portion 26 but to a lesser degree than the broad side walls. The converging walls provide the female joint casing 21 with a wedge-like aspect. The opposed broad and narrow side walls define planar interior cavity engagement surfaces.

Figure 9:
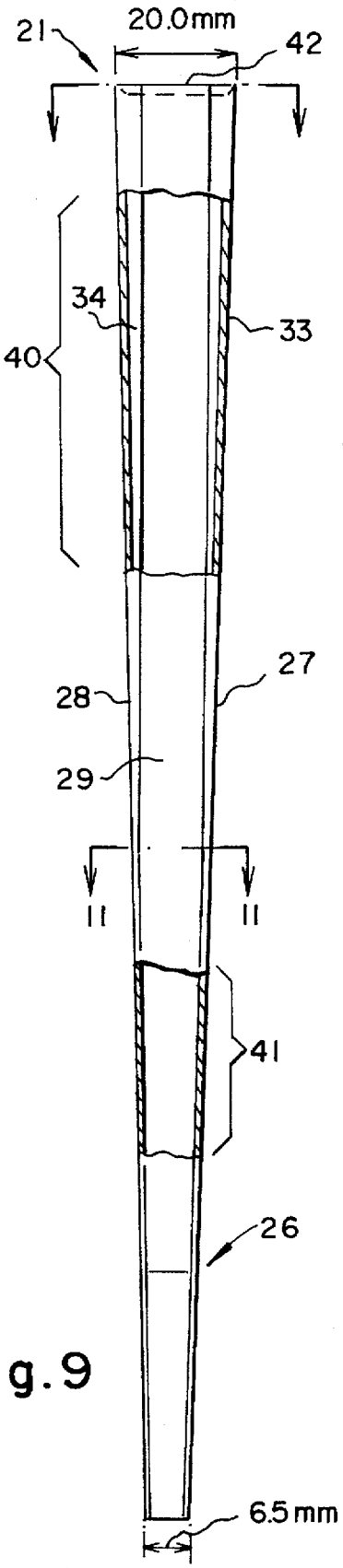
FIG. 9 is a side view of the female joint case shown in FIG. 8, the figure showing one of the two opposed narrow cavity side walls thereof.
Figure 8:
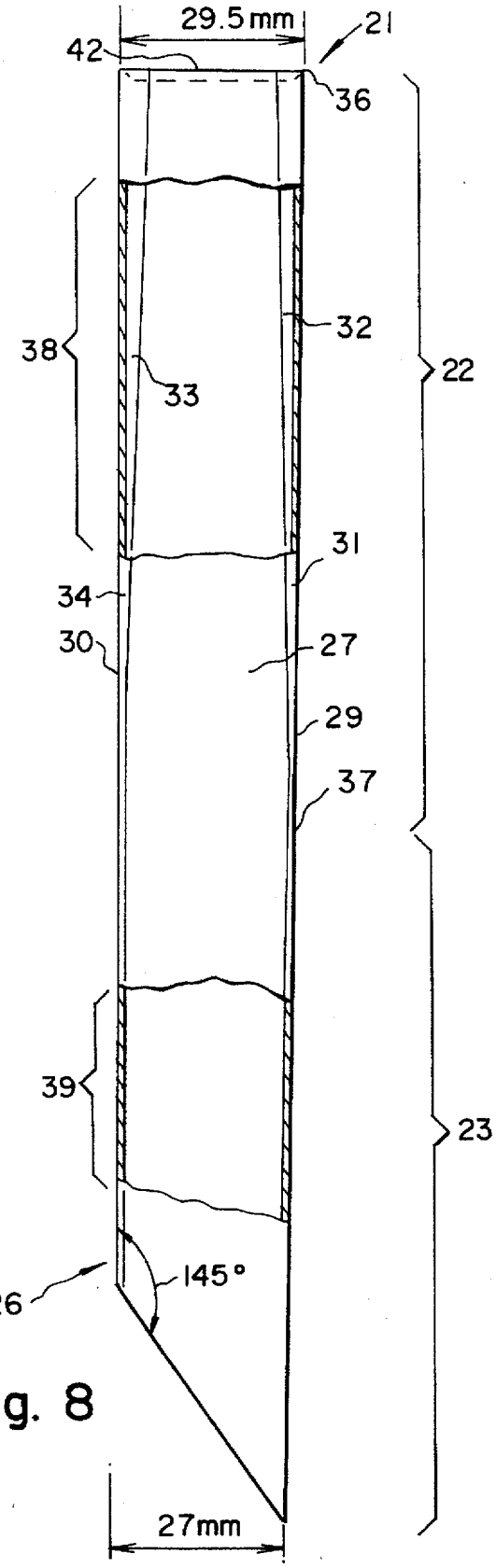
FIG. 8 is a side view of a female joint case defining a cavity having a shape generally corresponding to the shape of the male element illustrated in FIGS. 1 to 7, element, the figure showing one of the two opposed broad cavity side walls thereof.

The walls 27, 28, 29 and 30 are linked together by four corners 31, 32, 33 and 34. These corners define rounded inner (cavity) surfaces, each of which presents a concave inner surface over the entire length of the female joint casing 21. These corners, as in the case of the corners of the male elements described above, each have the same inner radius of curvature for any cross-section of the female joint casing 21; the inner radius of one corner is designated by the arrow 35. However, the inner radius of curvature of each these corners diminishes going from the top part 36 of portion 22 to the top part 37 of the lower portion 23 of the female joint casing 21. Thus, over the length of the portion 22 of the female casing 21, the inner radius of curvature changes i.e. gets smaller. The inner radius of curvature for the portion 22 may take on any desired values, keeping in mind that the surfaces of these corners are to be spaced apart from corresponding surfaces of the male element for the purpose of defining the above mentioned corner pockets; the radius of curvature for each of the corners may, for example, vary from 4 mm at top part 36 to 0.5 mm at top part 37. In FIGS. 8 and 9 portions of the side walls 27 and 29 respectively have been cut away so as to expose the interior of the cavity 24, i.e. portions 38, 39, 40 and 41.

The radius of curvature of each of the interior cavity surfaces of corners 27 to 30 in the portion 23 of the female joint casing 21, is substantially constant over the entire length of this portion e.g. at 0.5 mm.

As may be seen the bottom 26 is cut at an obtuse angle so as to present an angled end edge; the obtuse angle may take any desired value (e.g. from above 90 to below 180 degrees). In the embodiment shown the obtuse angle is 145 degrees. This obtuse angle may, for example, if desired, correspond to the obtuse angle between the shank and the blade of a blade component (see FIG. 15).

The female joint case 21 is also provided with an inner countersunk shoulder 42 angled so as to seat the shoulder 20 of the above described male element 3. Although the example embodiments of the male and female elements in FIGS. 1 to 9 are shown with respective shoulder members, these shoulder members may of course be dispensed with; in particular, if the male element is of fiber reinforced construction the shoulders are preferably not present. For example, turning to FIGS. 24 and 25 a male element is shown which does not have a shoulder 20; apart from this, all other elements of the male element shown in FIGS. 24 and 25 are the same as those shown for the male element illustrated in FIGS. 1 to 6 so that the same reference numerals are used to designate the common elements. As may be seen from FIGS. 24 and 25, the tapering of the male element from the tip end of the shaft, continues (more or less smoothly) until the tapering reaches the dimensions of the main handle component 1.

FIG. 12*a* shows in schematic form, a cut away view an inner corner of the interior of a female element while FIG. 12*b* shows a side of a male element; the elements are of rectangular configuration. The female element has a top part 43 and a bottom part 44. The inner cavity surface has a corner portion 45 which is rounded while the remaining lower part of the corner is more or less square. The radius of curvature of the portion 45 diminishes from the top part 43; e.g. the radius of curvature of corner part 46 is larger than the radius of curvature of corner part 47.

Referring to FIG. 12*b*, this figure shows a partial side view in the direction of a broad side wall of an elongated handle with a male element. The handle has an upper part 48 and a male part 49; the male part has a terminal part 50. The male part also has a portion 51 wherein the outer surface has a radius of curvature which reduces in value until the lower part of portion 45 is reached whereafter the corner is more or less square.

Male and female elements such as shown in FIGS. 12*a* and 12*b* may be used in cases where it is not desired that the corner pockets extend the full length of the cavity. In this case, the male and female parts are configured relative to each other such that the corners of the portions 45 and 51 are spaced apart whereas the corners of the lower portion may be in frictional contact.

FIGS. 13*a* and 13*b* show alternate embodiments of the female and male elements analogous to FIGS. 12*a* and 12*b* but wherein the facing corner members are to define corner pockets which extend along the length of the cavity; again the elements are rectangular in configuration. Thus in FIG. 13*a* the female element has a top part 52 and a bottom part 53. The inner cavity corner portion 54 extends over the full length of the cavity. The radius of curvature of the inner corner surface diminishes gradually from top to bottom, i.e. the radius of curvature of the corner parts 55, 56, 57 and 58 is such that the part 55 has the largest radius and the part 58 the smallest, with the smallest radius being that of the corner adjacent the bottom part 53.

Referring to FIG. 13*b*, this figure shows a partial side view in the direction of a broad side wall of an elongated handle with a male element. The handle has an upper part 59 and a male part 60; the male part has a terminal part 61. The male part also has a corner portion 62 which extends its full length wherein the rounded outer surface of the corner has a radius of curvature which reduces in value right until the bottom part 61 is reached.

Male and female elements such as shown in FIGS. 13*a* and 13*b* may be used in cases where it is desired that the corner pockets extend the full length of the cavity. In this case, the male and female parts are configured relative to each other such that the corners of the portions 54 and 62 are spaced apart to form the desired corner pockets.

The above FIGS. 1 to 13 have illustrated corner surfaces which define corner pockets as being similarly curved, i.e. either convex or concave surfaces. Other surface configurations are also possible.

FIG. 14 shows a cross sectional view of an example of a male element 63 the engagement surfaces of which are in frictional engagement with the corresponding engagement surfaces of the walls defining the cavity of the female element 64. The male and female elements are of rectangular cross-section and have respective corner surfaces configured so as to provide differently shaped corner pockets at the four corners. Thus the female element has rounded inner corner surfaces 65, 66 and 67 which have the same inner radius of curvature. The female element also has a corner with a flat or planar surface 68.

The male element 63 on the other hand has a corner with a rounded outer surface 69 which has a radius of curvature less than that of the rounded surface 70 of another corner. The male element 63 also has two corners wherein the outer surfaces 71 and 72 are flat or planar.

In FIG. 14 the corner pockets 73, 74, 75 and 76 may thus be seen as having different cross sectional configurations. Thus the corner pockets need not all have the same configuration as is the case for the male and female elements discussed with respect to FIGS. 1 to 13.

FIGS. 15 and 16 show how a female joint case, such as discussed with respect to FIGS. 8 to 11, may incorporated into a blade component. As seen from FIG. 15 the blade 77 has a slot 78 configured to receive the lower part of a female joint case 79. The slot 78 has a shape conforming to that of the lower part of the female case 79 so that the case 79 may be seated therein. The blade itself may be made of any suitable material and may for example also be composed of synthetic fiber impregnated materials such as referred to above.

The joining of the female joint case 79 to the blade 77 may take place in known fashion (see for example U.S. Pat. No. 4,059,269). Thus, for example, with the lower end of the female joint case 79 seated flush in the slot 78, resin impregnated fiber fabric may be disposed over each of the opposed face surfaces of a blade 77 so as to provide flap portions which may extend over and cover the opposed lower broad surfaces of the female joint case. Thereafter, the whole may be cured in a pressure mold to harden the fiber reinforced layer about the heel end of the obtained blade component. Once the blade component is cured with the female case in place, the female case defines the socket element of the blade component. The socket cavity has a bottom part 80 which is disposed in the heel portion of the blade component which is ready to receive the terminal portion of an appropriately configured male element.

The cured blade component may be worked to remove any excess glue material including fiber material that extends beyond the edges the blade. This can be done in a conventional manner such as by cutting, sanding or grinding. This method is well known in the art.

The blade component has a toe portion indicated generally by the reference number 81.

The blade as shown in FIGS. 15, 16 and 17 also includes a wear resistant member 82 for contacting the ice surface (see U.S. Pat. No. 3,982,760 for a further discussion of such members), this member may take the aspect of a thermoplastic wear protection bottom piece.

Although the various components have been shown by way of example to be made of synthetic fiber reinforced materials they may of course be made of wood, of other synthetic material or even a lightweight metal material such as aluminum.

Turning to FIG. 17 this figure shows how the above described example rectangularly configured handle and blade components may be joined and separated.

The handle component is shown with an elongated member designated by the reference number 83 and a male end element designated by the reference number 84. In the figure, a narrow side member is designated by the reference number 85 and a broad side member is designated by the reference number 86. The male member has a terminal portion designated by the reference number 87.

The blade component has a shank member designated by the reference number 88. The shank member which is provided with a socket element has an opening designated by the reference number 89 and includes the bottom cavity portion 80.

The handle component and blade component are disposed such that the terminal part 87 is adjacent the opening 89. In this position the male element is then pushed into the cavity of the shank member until the terminal portion is in the bottom part 80 of the cavity; at this point the dimensions of the male element are such that the components are frictionally engaged as herein described. The opposite steps are taken to separate the components, i.e. they are pulled apart manually or by using suitable mechanical aids.

FIGS. 18 to 19 show an alternate arrangement for the socket and male elements, namely the disposition of the socket element at the end of the handle and the disposition of the male element as the shank element of a blade component. An advantage of this alternate embodiment shown in FIGS. 18 to 22 is that if for any reason the elongated handle element should become disengaged from the blade element while a user or hockey player is on the ice, the player will have an essentially blunt ended handle rather than a handle having a spear like aspect; the spear like aspect in such circumstances may result in an increase in risk of injury to the player or others on the ice.

The male and female elements shown in FIGS. 18 to 23 are rectangular in cross section and have the same shape as that of the previously described embodiments thereof. FIGS. 21 and 22 show cross sections of the female or socket element with a rectangular cavity and rounded inner corner surfaces one of which is designated by the reference number 92. The female element is disposed in the end part of an elongated handle the upper part of which is designated by the number 93. The female part has an opening 94 and a bottom part 95. FIG. 18 shows one broad cavity wall member 96 while FIG. 19 shows one narrow cavity wall member 97. FIGS. 22 and 23 shows a male element defining a shank member of a blade component; the blade being the same as the blade shown in FIG. 15. FIG. 22 shows a broad wall member 99 and FIG. 23 shows a narrow wall member 99.

I claim:

1. A game stick comprising a blade component having a shank member and an elongated handle component having an end member said blade component comprising a blade having a toe portion and a heel portion, said shank member extending away from said heel portion and having an end remote from the heel portion, characterized in that one of said shank and said end members comprises a socket element and the other of said shank and said end members comprises a male element in that said male element has a tapered shape, said male element tapering to a terminal portion, in that said male element comprises a plurality of first side members and a plurality of first corner members, each first side member defining an engagement surface spacing apart two first corner members, in that said socket element comprises an opening, a plurality of cavity side members and a plurality of cavity corner members, each cavity side member defining an engagement surface spacing apart two cavity corner members, said cavity side members and said cavity corner members defining a cavity extending from said opening, said cavity having a bottom portion remote from said opening, in that said male element and said cavity are configured so that said male element is telescopically engaged within the cavity of said socket element in tight frictional gripping relation such that the elongated handle component and the blade component are thereby rigidly and detachably secured together, the first side members and respective cavity side members define a plurality of pairs of facing side members, each pair of facing side members comprising a first side member disposed opposite a respective cavity side member, and the first corner members and respective cavity corner members define a plurality of pairs of facing corner members, each pair of facing corner members comprising a first corner member disposed opposite a respective cavity corner member, in that, for each pair of facing side members, the engagement surfaces thereof, are in said frictional gripping relation, and in that, for at least one pair of facing corner members, the first corner member and the cavity corner member thereof, are in a spaced apart relation, said spaced apart relation extending over at least a portion of the cavity corner member thereof.

2. A game stick as defined in claim i characterized in that, for each pair of facing corner members, the first corner member and the cavity corner member thereof, are in said spaced apart relation.

3. A game stick as defined in claim 2 characterized in that, for each pair of facing corner members, said spaced apart relation extends, from said opening, over at least a major portion of the cavity corner member thereof.

4. A game stick as defined in claim 2 characterized in that, for each pair of facing corner members, said spaced apart relation extends, from said opening, over at least a substantial portion of the cavity corner member thereof.

5. A game stick as defined in claim 2 characterized in that the end member of said elongated handle component comprises said male element and the shank member of said blade component comprises said socket element, and in that the opening of said socket element is disposed at said end of the shank member remote from the heel portion.

6. A game stick as defined in claim 5 characterized in that said bottom portion of the cavity is disposed in said heel portion of the blade and the terminal portion of said male element is disposed in said bottom portion of the cavity.

7. A game stick as defined in claim 5 characterized in that, for each pair of facing corner members, said spaced apart relation extends, from said opening, over at least a major portion of the cavity corner member thereof.

8. A game stick as defined in claim 5 characterized in that, for each pair of facing corner members, said spaced apart relation extends, from said opening, over at least a substantial portion of the cavity corner member thereof.

9. A game stick as defined in claim 7 characterized in that, for each pair of facing corner members, said spaced apart relation extends from the opening to said bottom portion of said cavity.

10. A game stick as defined in claim 3 characterised in that the engagement surface of each first side member is a planar surface, and in that the engagement surface of each cavity side member is a planar surface.

11. A game stick as defined in claim 3, characterized in that said cavity has a rectangular cross-sectional shape, in that said cavity side members consist of a pair of opposed broad cavity side members and a pair of opposed narrow cavity side members, in that each cavity corner member connects together a broad cavity side member and a narrow cavity side member, in that said male element has a rectangular cross-sectional shape, in that said first side members consist of a pair of opposed broad first side members and a pair of opposed narrow first side members, in that each first corner member connects together a broad first side member and a narrow first side member, in that the broad and narrow first side members each define a planar engagement surface, in that the broad and narrow cavity side members each define a planar engagement surface, in that the planar engagement surfaces of said broad first side members converge towards each other to said terminal portion, in that the planar engagement surfaces of said narrow first side members converge towards each other to said terminal portion, in that the planar engagement surfaces of said broad cavity side members converge inwardly towards each other from said opening of said socket element to said bottom portion, in that the planar engagement surfaces of said narrow cavity side members converge inwardly towards each other from said opening of said socket element to said bottom portion, in that the planar engagement surface of each broad first side member frictionally engages the planar engagement surface of a respective broad cavity side member in said frictional gripping relation and in that the planar surface of each narrow first side member frictionally engages the planar surface of a respective narrow cavity side member in said frictional gripping relation.

12. A game stick as defined in claim 11 characterized in that, for each pair of facing corner members, the first corner member comprises a convexly curved corner surface and the respective cavity corner member comprises a concavely curved corner surface, and in that, for each pair of facing corner members, over said at least major portion of the respective cavity corner member extending from said opening, the convexly curved surface of the first corner member, has a radius of curvature greater than the radius of curvature of the concavely curved surface of the respective cavity corner member.

13. A game stick as defined in claim 11 characterized in that, for each pair of facing corner members, the first corner member comprises a convexly curved corner surface and the respective cavity corner member comprises a concavely curved corner surface, and in that, for each pair of facing corner members, over at least a substantial portion of the respective cavity corner member extending from said opening, the convexly curved surface of the first corner member has a radius of curvature greater than the radius of curvature of the concavely curved surface of the respective cavity corner member.

14. A game stick as defined in claim 12 characterized in that the end member of said elongated handle component comprises said male element and the shank member of said blade component comprises said socket element, and in that the opening of said socket element is disposed at said end of the shank member remote from the heel portion.

15. A game stick as defined in claim 14 characterized in that said bottom portion of the cavity is disposed in said heel portion of the blade and the terminal portion of said male element is disposed in said bottom portion of the cavity.

16. A game stick as defined in claim 13 characterized in that the end member of said elongated handle component comprises said male element and the shank member of said blade component comprises said socket element, and in that the opening of said socket element is disposed at said end of the shank member remote from the heel portion.

17. A game stick as defined in claim 16 characterized in that said bottom portion of the cavity is disposed in said heel portion of the blade and the terminal portion of said male element is disposed in said bottom portion of the cavity.

18. A game stick as defined in claim 3 characterized in that said male element is hollow.

19. A game stick as defined in claim 5 characterized in that said male element is hollow.

20. A game stick as defined in claim 3 characterized in that the shank member and the end member are of fiber reinforced plastic material.

21. A game stick as defined in claim 15 characterized in that the shank member and the end member are of fiber reinforced plastic material.

22. A game stick as defined in claim 17 characterized in that the shank member and the end member are of fiber reinforced plastic material, said male element is hollow and said socket element comprises relatively thin walls.

23. A kit for making a game stick comprising an elongated handle and a blade, said kit comprising a blade component having a shank member and an elongated handle component having an end member said blade component comprising a blade having a toe portion and a heel portion, said shank member extending away from said heel portion and having an end remote from the heel portion, characterized in that one of said shank and said end members comprises a socket element and the other of said shank and said end members comprises a male element, in that said male element has a tapered shape, said male element tapering to a terminal portion, in that said male element comprises a plurality of first side members and a plurality of first corner members, each first side member defining an engagement surface spacing apart two first corner members, in that said socket element comprises an opening, a plurality of cavity side members and a plurality of cavity corner members, each cavity side member defining an engagement surface spacing apart two cavity corner members, said cavity side members and said cavity corner members defining a cavity extending from said opening, said cavity having a bottom portion remote from said opening, in that said male element and said cavity are configured so that said male element is telescopically engageable within the cavity of said socket element in tight frictional gripping relation such that the elongated handle component and the blade component are thereby rigidly and detachably secured together, the first side members and respective cavity side members define a plurality of pairs of facing side members, each pair of facing side members comprising a first side member disposed opposite a respective cavity side member, and the first corner members and respective cavity corner members define a plurality of pairs of facing corner members, each pair of facing corner members comprising a first corner member disposed opposite a respective cavity corner member, and in that the first corner members and the cavity corner members are configured such that, when the male element is telescopically engaged within the cavity of said socket element, for each pair of facing side members, the engagement surfaces thereof, are in said frictional gripping relation, and for at least one pair of facing corner members, the first corner member and the cavity corner member thereof, are in a spaced apart relation, said spaced apart relation extending over at least a portion of the cavity corner member thereof.

24. A kit as defined in claim 23 characterized in that the first corner members and the cavity corner members are configured such that, when the male element is telescopically engaged within the cavity of said socket element, for each pair of facing corner members, the first corner member and the cavity corner member thereof, are in said spaced apart relation.

25. A kit as defined in claim 23 characterized in that the first corner members and the cavity corner members are configured such that, when the male element is telescopically engaged within the cavity of said socket element, for each pair of facing corner members, the first corner member and the cavity corner member thereof, are in said spaced apart relation, said spaced apart relation extending, from said opening, over at least a major portion of the cavity corner member thereof.

26. A kit as defined in claim 23 characterized in that the first corner members and the cavity corner members are configured such that, when the male element is telescopically engaged within the cavity of said socket element, for each pair of facing corner members, the first corner member and the cavity corner member thereof, are in said spaced apart relation, said spaced apart relation extending, from said opening, over at least a substantial portion of the cavity corner member thereof.

27. A kit as defined in claim 24 characterized in that the end member of said elongated handle component comprises said male element and the shank member of said blade component comprises said socket element, in that the opening of said socket element is disposed at said end of the shank member remote from the heel portion.

28. A kit as defined in claim 27 characterized in that said bottom portion of the cavity is disposed in said heel portion of the blade and, when the male element is telescopically engaged within the cavity of said socket element, the terminal portion of said male element is disposed in said bottom portion of the cavity.

29. A kit as defined in claim 27 characterized in that said spaced apart relation extends, from said opening, over at least a major portion of the cavity corner member thereof.

30. A kit as defined in claim 27 characterized in that said spaced apart relation extends, from said opening, over at least a substantial portion of the cavity corner member thereof.

31. A kit as defined in claim 29 characterized in that said spaced apart relation extends from the opening to said bottom part of said cavity.

32. A kit as defined in claim 24 characterised in that the engagement surface of each first side member is a planar surface, and in that the engagement surface of each cavity side member is a planar surface.

33. A kit as defined in claim 24, characterized in that said cavity has a rectangular cross-sectional shape, in that said cavity side members consist of a pair of opposed broad cavity side members and a pair of opposed narrow cavity side members, in that each cavity corner member connects together a broad cavity side member and a narrow cavity side member, in that said male element has a rectangular cross-sectional shape, in that said first side members consist of a pair of opposed broad first side members and a pair of opposed narrow first side members, in that each first corner member connects together a broad first side member and a narrow first side member, in that the broad and narrow first side member planar define a planar engagement surface, in that the broad and narrow cavity side members each define a planar engagement surface, in that the planar engagement surfaces of said broad first side members converge towards each other to said terminal portion, in that the planar engagement surfaces of said narrow first side members converge towards each other to said terminal portion, in that the planar engagement surfaces of said broad cavity side members converge inwardly towards each other from said opening of said socket element to said bottom portion, in that the planar engagement surfaces of said narrow cavity side members converge inwardly towards each other from said opening of said socket element to said bottom portion, in that said male element and said cavity are configured so that said male element is telescopically engageable within the cavity of said socket element such that each broad first side member faces a respective broad cavity side member and each narrow first side member faces a respective narrow cavity side member, in that the planar surface of each broad first side member is able to frictionally engage the planar surface of a respective broad cavity side member in said frictional gripping relation, and in that the planar surface of each narrow first side member is able to frictionally engage the planar surface of a respective narrow cavity side member in said frictional gripping relation.

34. A kit as defined in claim 33 characterized in that, for each pair of facing corner members, the first corner member comprises a convexly curved corner surface and the respective cavity corner member comprises a concavely curved corner surface, and for each pair of facing corner members, over at least a portion of the respective cavity corner member extending from said opening, the convexly curved surface of the first corner member has a radius of curvature greater than the radius of curvature of the concavely curved surface of said respective cavity corner member.

35. A kit as defined in claim 33 characterized in that, for each pair of facing corner members, the first corner member comprises a convexly curved corner surface and the respective cavity corner member comprises a concavely curved corner surface, and for each pair of facing corner members, over at least a substantial portion of the respective cavity corner member extending from said opening, the convexly curved surface of the first corner member has a radius of curvature greater than the radius of curvature of the concavely curved surface of said respective cavity corner member.

36. A kit as defined in claim 34 characterized in that the end member of said elongated handle component comprises said male element and the shank member of said blade component comprises said socket element, and in that the opening of said socket element is disposed at said end of the shank member remote from the heel portion.

37. A kit as defined in claim 36 characterized in that said bottom portion of the cavity is disposed in said heel portion of the blade and, when the male element is telescopically engaged within the cavity of said socket element, the terminal portion of said male element is disposed in said bottom portion of the cavity.

38. A kit as defined in claim 35 characterized in that the end member of said elongated handle component comprises said male element and the shank member of said blade component comprises said socket element, and in that the opening of said socket element is disposed at said end of the shank member remote from the heel portion.

39. A kit as defined in claim 38 characterized in that said bottom portion of the cavity is disposed in said heel portion of the blade and, when the male element is telescopically engaged within the cavity of said socket element, the terminal portion of said male element is disposed in said bottom portion of the cavity.

40. A kit as defined in claim 25 characterized in that said male element is hollow.

41. A kit as defined in claim 27 characterized in that said male element is hollow.

42. A kit as defined in claim 25 characterized in that the shank member and the end member are of fiber reinforced plastic material.

43. A kit as defined in claim 37 characterized in that the shank member and the end member are of fiber reinforced plastic material.

44. A kit as defined in claim 39 characterized in that the shank member and the end member are of fiber reinforced plastic material, said tapered male element is hollow and said socket element comprises relatively thin walls.

* * * * *

UNITED STATES PATENT AND TRADEMARK OFFICE

CERTIFICATE OF CORRECTION

PATENT NO. : 5,718,647

DATED : February 17th, 1998

INVENTOR(S) : TIITOLA, Antti-Jussi

It is certified that error appears in the above-identified patent and that said Letters Patent is hereby corrected as shown below:

At column 15, line 11 should read as follows:

2. A game stick as defined in claim 1 characterized in that,

At column 19, line 15 should read as follows:

in that the broad and narrow first side members each

Signed and Sealed this

Twenty-ninth Day of August, 2000

*Attest:*

*Attesting Officer*

Q. TODD DICKINSON

*Director of Patents and Trademarks*